US007399285B2

(12) United States Patent
Stein

(10) Patent No.: US 7,399,285 B2
(45) Date of Patent: Jul. 15, 2008

(54) MASSAGE BALL AND METHOD OF USE

(76) Inventor: Howard L. Stein, 11 Springdale Ave., White Plains, NY (US) 10604

( * ) Notice: Subject to any disclaimer, the term of this patent is extended or adjusted under 35 U.S.C. 154(b) by 905 days.

(21) Appl. No.: 10/775,688

(22) Filed: Feb. 10, 2004

(65) Prior Publication Data

US 2005/0015032 A1 Jan. 20, 2005

Related U.S. Application Data

(63) Continuation-in-part of application No. 10/619,298, filed on Jul. 14, 2003, now abandoned.

(51) Int. Cl.
*A61H 1/00* (2006.01)

(52) U.S. Cl. ..... 601/15; 601/19; 601/131

(58) Field of Classification Search ..... 601/15, 601/19, 128, 131, 132
See application file for complete search history.

(56) References Cited

U.S. PATENT DOCUMENTS

| | | | | |
|---|---|---|---|---|
| 2,466,470 | A | 4/1949 | Norris | |
| 4,082,089 | A * | 4/1978 | Moriyama et al. | 601/19 |
| 4,198,962 | A | 4/1980 | McCauley | |
| 4,329,981 | A | 5/1982 | Dungl | |
| 4,347,838 | A | 9/1982 | McCauley | |
| 4,446,855 | A | 5/1984 | Friedson | |
| 4,807,602 | A | 2/1989 | Scarborough et al. | |
| 4,846,159 | A | 7/1989 | Anzai et al. | |
| 5,056,507 | A | 10/1991 | Yum | |
| 5,263,474 | A | 11/1993 | Agader | |
| 5,411,470 | A | 5/1995 | Liptak et al. | |
| 5,605,533 | A | 2/1997 | Badilla | |
| 5,725,484 | A * | 3/1998 | Burnham | 601/128 |
| 5,779,652 | A * | 7/1998 | Mencher-Aliazzo | 601/132 |
| 5,785,668 | A | 7/1998 | Shimizu | |
| D403,076 | S | 12/1998 | York | |
| 5,868,689 | A | 2/1999 | Faroky et al. | |
| 6,616,550 | B2 * | 9/2003 | Nesbitt et al. | 473/374 |
| 6,866,776 | B2 | 3/2005 | Leason et al. | |
| 2002/0175100 | A1 * | 11/2002 | Holland et al. | 206/350 |
| 2003/0004443 | A1 | 1/2003 | Chan | |
| 2003/0009118 | A1 | 1/2003 | Sabo et al. | |
| 2003/0144616 | A1 | 7/2003 | Henderson | |

(Continued)

FOREIGN PATENT DOCUMENTS

| | | |
|---|---|---|
| WO | WO 00/66065 A1 | 9/2000 |

OTHER PUBLICATIONS

Sldade, Terry, Norman, Oklahoma, Chinese Health Ba;;s/ Revised Mar. 7, 2001. http://web.archive.org/web/20011111200635/http://www.ionet.net/~tslade/chinball.htm.*

(Continued)

*Primary Examiner*—Michael A. Brown
(74) *Attorney, Agent, or Firm*—Pandiscio & Pandiscio

(57) ABSTRACT

The invention relates to a massage ball having temperature retention properties such that the user can warm or cool the ball prior to using and then roll the ball with the underside of the foot against a rigid surface to provide a massaging effect simultaneously with either a therapeutic warming or cooling effect to the foot, depending upon the need of the user.

39 Claims, 3 Drawing Sheets

U.S. PATENT DOCUMENTS

| | | | | |
|---|---|---|---|---|
| 2004/0013849 | A1 * | 1/2004 | Kobayashi | 428/95 |
| 2004/0082886 | A1 | 4/2004 | Timpson | |

OTHER PUBLICATIONS http://info.product-finder.net/myss/Medium+Thermal +Massage+Ball.html (on-line catalog item—Prana Ball)—available prior to filing date.

http://www.mcsports.com/product/index.jsp?productId=1368024 (Homedics Sole Therapy Deluxe Vibration Footbath w/INrfared & Rollers)—available prior to filing date.

http://www.mcsports.com/product/index.jsp?productId=1283593 (on-line catalog item—Altus Massage Stick)—available prior to filing date.

http://www.mcsports.com/product/index.jsp?productId=1283592 (on-line catalog item—Altus Foot Massage and Balance Balls)—available prior to filing date.

http://www.lazycomfort.com/acfootmas.html (on-line catalog item—Accu-Flex Foot Massager)—available prior to filing date.

http://www.lazycomfort.com/footfootmas.html (on-line catalog item—Footsie Foot Massager)—available prior to filing date.

http://www.lazycomfort.com/woodfootmas.html (on-line catalog item—Foot Rub Massagers)—available prior to filing date.

B. Fullem, "Planting the Pain in Your Foot—What Causes Plantar Fascitis and How to Deal with It," https://www.runningtimes.com/issues/02apr/pf.htm (Apr. 2002).

http://www.widgets.ws/prod/Walter-Drake/Foot-Care/Hot-and-Cold-Foot-Massager.html (on-line catalog item—Hot and Cold Foot Massagers)—available prior to filing date.

http://www.luckycat.com/cgi-bin/tbasgo2.pl?2001nov+massager1a=jpg&page17&HE-ROLL&400&228&1 (on-line catalog item—Massage Roller)—available prior to filing date.

http://www.luckycat.com/cgi-bin/tbasgo2.pl?2001nov+massager2a=jpg&page17&HE-FT&400&200&1 (on-line catalog item—Foot Massager)—available prior to filing date.

* cited by examiner

MASSAGE BALL AND METHOD OF USE

CROSS-REFERENCE TO PRIOR APPLICATION

This application is a continuation-in-part of U.S. patent application Ser. No. 10/619,298, filed Jul. 14, 2003 now abandoned.

TECHNICAL FILED OF THE INVENTION

The invention relates to a non-deformable massage ball having temperature retention properties such that the user can warm or cool the ball prior to using and then roll the ball with the underside of the foot against a rigid surface to provide a massaging effect simultaneously with either a therapeutic warming or cooling effect to the foot, depending upon the need of the user.

BACKGROUND OF THE INVENTION

Both chronic and acute foot pain affect numerous people. The pain is often caused by one or more of the following conditions: inflammation, decreased blood flow, muscle strain, muscle tension or muscle fatigue. Relief from foot pain can often be obtained by massaging the bottom of the feet and/or by applying either heat or cold to the bottom of the feet.

The rolling of the foot over a tennis ball or a golf ball has been recommended as a massage therapy to treat plantar fascitis, an acute inflammation of the band of tissue that supports the arch. It has even been recommended to place the golf ball in the freezer prior to use (https://www.runningtimes.com/issues/02apr/pf.htm). Golf balls, however, tend to slip out from under the foot during the massage because of their light weight. Also when one attempts to roll a golf ball from the arch to the ball of the foot, it tends to slide out from under the foot unless the user releases pressure on the ball. This disadvantageously causes the user to lose the massage effect. Tennis balls are also too large are deformable—they compress and lose their shape under the pressure of the foot—and thus do not provide an optimal foot massage. Also, the fuzz on the surface of a tennis ball can cause discomfort, as well as shed during use. Moreover, neither golf balls or tennis balls hold cold or warm temperatures for a time sufficient to perform an effective massage.

Numerous foot massage devices are known in the art. U.S. Pat. No. 4,010,743 describes a foot massager composed of a frame which fits parallel rods, wherein each rod contains multiple beads. The user manually rolls the foot over the beads to provide the massage. U.S. Pat. Nos. 4,198,962 and 4,347,838 describe a similar apparatus where multiple rotatable balls are mounted on parallel bars and form a convex surface over which the user rubs the foot. The device may also be associated with an electrically driven vibrator. Products such as these are commercially available as the Wooden Foot Massager (www.lazycomfort.com/woodfootmas.html).

Another type of foot massager is described in U.S. Pat. No. 4,329,981. This device is a mat comprising a plurality of hill-like protuberance over and on top of which the user steps. A somewhat related device is described in U.S. Pat. No. 5,056,507. This device is a combined foot support/massager wherein the user places both feet on an inclined surface containing flexible nipples that contact the toe, sole and heel. The user may provide pressure onto the nippled surface to obtain a massage. The device optionally may contain a heating device within the base supporting the nippled, inclined surface. Rubber nipples contacting the bottom of the foot also provide the massaging action in the device described in U.S. Pat. No. 4,807,602. This device further comprises an electric motor which moves a plate upon which the nipples are mounted. The device further comprises pulsating spray nozzles and a heater which spray the bottom of the users feet with warm water under a variable amount of pressure providing additional massage action and the added benefit of heat.

U.S. Pat. No. 4,446,855 describes a vibrator plate and associated heating element combined with foot-shaped recesses into which the user places the feet for a massage combined with heat.

A massager composed of a cylindrical rod containing protrusions and connected on either end to rollers is described in U.S. Pat. No. 5,411,470. Products such as these are sold as the Accu-Flex Foot Massager and the Footsie Foot Massager (see www.lazycomfort.com/footfootmas.html and www.lazycomfort.com/acfootmas.html). A product known as the Hot and Cold Foot Massager is simply a ridged cylinder divided into two hollow compartments that may be independently filled with cold and hot water (Walter Drake, item #14933) thus providing heat or cold in addition to the massage.

The use of balls to provide foot massage are also known in the art. U.S. Pat. No. 5,785,668 describes an electronic device that simultaneously provides both a vibrating massage and a kneading massage to a body part, where the kneading massage is performed by balls in the device. U.S. Pat. No. 5,605,533 discloses a touch activated foot massager where the bottom of the foot contacts a plurality of rubber balls that driven by a motor vibrate and move, thus providing the massage. PCT Publication No. WO 00/66065 discloses a massage plate with ball holes and balls in the holes. The user rolls his feet over the balls to provide the massage.

Manual ball massagers are also known. U.S. Pat. No. 5,868,689 describes a ball on a flexible cord in between two handles allowing the user to grasp the handles and place the ball between the area of the body to be massaged and a wall, floor or chair. United States Patent Publication No. US 2003/0009118 discloses a rubber massage ball with protrusions attached to a handle strap for providing a massage to various body parts. The Altus Foot Massage and Balance Ball (www.mcsports.com; item#1283592) is a rubber ball or half ball with protrusions. A spongy, soft rubber massage ball having a tacky surface, called a Prana Ball, is said to be able to be warmed or chilled and then used for massage on various parts of the body, including the foot (http://info.product-finder.net/myss/Medium+Thermal+Massage+Ball.html). However, rubber balls and balls made out of other materials that deform easily when pressure is applied to them and thus do not provide sufficient resistance against the foot to give an effective massage. Moreover, the Prana Ball does not appear to be able to retain heat or cold for a sufficient period for an effective massage.

Despite the various massagers on the market, many are not optimally designed for the foot. Those that are designed principally to massage the foot are either not portable, not capable of being heated, cooled or both, require filling with water and thus are prone to leakage or spillage, or require time and space to set up before use. Thus, there still exists a need for a portable, relatively light-weight foot massage apparatus that can be easily heated or cooled and will retain that heat or cold for a time sufficient to administer a massage.

SUMMARY OF THE INVENTION

Applicant has solved this problem by providing a massage ball uniquely designed for massaging the underside of the foot. The massage is achieved by simultaneously contacting the ball with the underside of the foot and a rigid surface and moving the foot while maintaining sufficient pressure between said ball and said underside of the foot so as to roll said ball against both said rigid surface and said underside of the foot for a time sufficient to administer said massage. The ball is made of a material that can be easily heated or cooled by a short submersion in hot or cold tap water and which will not deform under the pressure of the foot during the massage.

Specifically, the ball is between 1.5 and 2 inches in diameter and weighs between 3 and 24 ounces. The ball is preferably cooled by submersion in cold water having a temperature of about 55° F. or preferably heated by submersion in hot water having a temperature of about 115° F. for about a minute or less immediately prior to initiation of said massage. This sufficiently warms or cools the ball so that a therapeutic hot or cold sensation is felt by the user during the massage.

The massage ball of this invention is provided individually wrapped as part of a kit additionally containing instructions for use. The kit of this invention may additionally contain one or more of: a device for heating or cooling the ball; a non-skid mat to roll the ball against for ease of use when using the massage ball on a slippery surface, such as a wood or tile floor; or a storage device for the ball when not in use. Additionally, the ball may be magnetized and optionally packaged together with a mat made out of a sheet magnet. This embodiment provides further protection against the ball slipping out from under the foot during the massage.

The invention also provides methods of massaging the bottom of the foot using the heated or cooled ball.

DETAILED DESCRIPTION OF THE INVENTION

Figure 1:
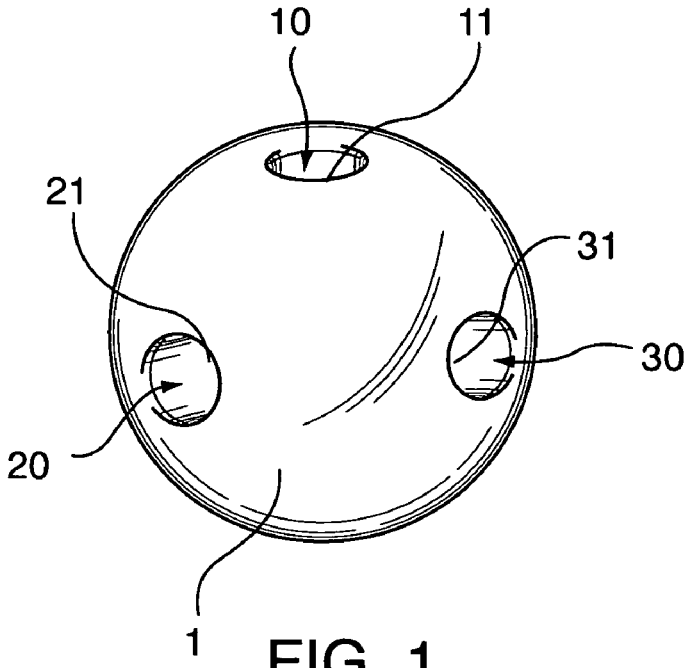
FIG. 1 depicts a top front view perspective of a preferred massage ball of this invention.

According to one embodiment, the invention provides a method of massaging an underside surface of a human foot, while simultaneously providing therapeutic heat or cold to said foot, comprising the steps of:

a) simultaneously contacting a freestanding ball with both the underside surface of the foot and a rigid surface; and
b) moving said foot while maintaining sufficient pressure between said ball and said underside of the foot so as to roll said ball against both said rigid surface and said underside of the foot for a time sufficient to administer said massage, wherein said ball is between 1.5 and 2 inches in diameter, weighs between 3 and 24 ounces, does not deform during said massage, and wherein the temperature of the surface of said ball at initiation of said massage is sufficiently cold or sufficiently warm to provide the user with therapeutic cold or warmth during the course of an effective massage, wherein said ball optionally comprises an aperture and wherein said ball optionally contains a flat face.

The term "therapeutic cold or warmth" as used herein means that the ball feels cold or warm while in contact with the underside of the user's foot. While sensitivity of the underside of the foot to hot and cold can vary from user to user, I believe that a ball surface starting temperature of between about 45° F. and 65° F. feels cold to the average user and between about 95° F. and 120° F. feels warm to the average user during the course of an effective massage, while still being tolerable to the foot. The term "about" as used herein to describe temperatures, diameters, weights and lengths is meant to denote standard variations in the accuracy of measuring devices and represents ±5%.

The term "effective massage" or "effective foot massage" as used herein means a massage, wherein said user contacts their foot with the massage ball as described below, of sufficient length and intensity, when combined with the therapeutic heat or cold provided by the ball, to provide a detectable reduction in the severity of foot pain caused one or more of the following as measured subjectively by the user: inflammation, decreased blood flow, muscle strain, muscle tension or muscle fatigue. Of course, one need not be suffering from any of the above conditions to use the massage ball. It is well-known that massage, particularly foot massage, can contribute to one's well-being and generally is pleasurable. The time of use sufficient to provide an effective massage will vary with the user, but is typically about 3 to 8 minutes, more preferably 4 to 6 minutes. Shorter times of use will provide less satisfactory therapeutic results, while longer times of use may cause pain or stress on the foot, which counteract the beneficial effects of the massage and heat or cold. Accordingly, the term "effective massage" as used herein also means the use of the massage ball as specified above for a duration of at least 3 minutes.

In the embodiment set forth above, the user places the pre-heated or pre-cooled ball on a rigid surface, typically a floor. The massage ball requires no special holder or other restraint for use. It is simply freestanding on the rigid surface. Next the user contacts the underside of his or her foot with the ball, while either sitting or standing, and applies pressure while moving that foot. The amount of pressure applied to the ball can be varied to administer varying intensities of massage. The useful range of pressure applied should be high enough to allow movement of the user's foot to cause the ball to roll the ball against the underside of the foot while delivering both a massaging action and therapeutic heat or cold, yet low enough so as to not cause the ball to slip out from under the foot causing a loss of contact between the foot and the ball. This range of pressures is referred to hereinafter as the "effective pressure range" of the ball.

It will be apparent that the effective pressure range will vary depending upon a number of factors, such as the size and weight of the ball, the nature of the rigid surface against which the ball is rolled, the surface texture of the ball, the temperature of the ball, the amount of moisture on the ball and the underside of the foot, and which part of the underside of the foot is contacting the ball. The user, however, will be able to judge all of these factors empirically in the process of using the ball for the massage. Variation of pressures within the effective pressure range will determine the intensity of the massage and is under the complete control of the user. Typically the user will vary pressure within the effective pressure range during the course of the massage based upon need and the particular portion of the underside of the foot being massaged.

The movement of the foot that causes the ball to roll may be in any direction—heel-to-toe, toe-to-heel, side-to-side, circular or diagonal—and is preferably varied throughout the course of the massage. The choice of direction is also determined by which particular part of the underside of the foot the user desires to be massaged. Again the user has complete control of which foot movement combinations will be employed during the massage.

The rigid surface against which the ball is rolled during the massage may be a hard floor, such as wood, tile, linoleum, concrete, stone, brick, or any other floor surface typically found in and around a home. Alternatively, the rigid surface may be a carpet or a rug sitting on top of the hard floor. In one alternate embodiment of the invention, the rigid surface is a mat comprising at least one non-skid surface, which is placed on top of a floor, carpet or rug. In an alternate embodiment, the rigid surface is a sheet magnet which, when used in conjunction with a magnetized ball, assists in preventing the ball from slipping out from under the foot, thus allowing greater pressure to be exerted on the ball and providing a deeper, stronger massage.

The ball itself is preferably solid, although hollow balls of sufficient weight and size can be successfully used. Applicant has determined that a ball between 1.5 and 2 inches in diameter provides the most beneficial massage because the user can apply higher pressure on the ball and obtain a deeper massage than with a ball of smaller diameter. Smaller diameter balls (0.5 to 1.4 inches) can be effectively utilized in this invention, but may cause pain to more sensitive portions of the foot in some individuals when pressure at the higher end of the useful range is applied. At such higher pressures it might feel that the ball is "digging into" the foot of certain individuals. The choice of size is also dependent upon the size of a users foot. Accordingly a smaller diameter ball would be more effective for a smaller foot, such as that of a child or an adolescent or an adult of smaller statute. Most preferably, the ball is about 1.75 inches in diameter.

The ball should also have sufficient weight to prevent slippage from under the foot, but not be so heavy as to lose portability. Applicant has found that a range of weight between 3 and 24 ounces to be ideal for this purpose. In one preferred embodiment, the ball has a weight of between 6 and 24 ounces and lacks apertures. More preferably in this embodiment, the ball has a weight of between 12 and 14 ounces and lacks apertures. The weight of the ball will be dependent upon the diameter of the ball, the material of which the ball is made and whether the ball is hollow or solid.

According to an alternate preferred embodiment, the ball has a weight of between 3 and 24 ounces and comprises one or more apertures. More preferably in this embodiment, the ball weighs between 3 and 10 ounces and comprises one or more apertures. Even more preferably, this lighter ball is made out of aluminum or an aluminum composite.

As stated above, in some preferred embodiments, the ball contains one or more apertures, preferably between one and 50 apertures having diameters ranging from 1/16 of an inch to 3/4 of an inch. The apertures need not be of equal diameters. Moreover the apertures may be of varying depths into the ball. Preferably, at least one aperture runs entirely through the ball, more preferably through the entire diameter of the ball. Apertures of the entire diameter of the ball result in two openings on the surface of the ball—one each at opposite ends along a particular axis. Alternatively apertures can be made through an arc of the ball, which again results in two openings on the surface of the ball. Apertures are preferably created by drilling into the ball with an appropriate sized drill bit or the like. Multiple apertures in the massage ball of this invention may intersect or not, regardless of whether such apertures go through the entire ball. For example, a massage ball of this invention may contain two apertures—the first of which is created along the X-axis and is the depth of the radius of the ball and the second of which is created along the Y-axis, is the depth of the radius of the ball and therefore intersects the first aperture.

According to a more preferred embodiment, the invention provides a massage ball that is non-deformable under the pressure of the massage, weighs between about 3 and about 10 ounces, has a diameter of between about 1 3/4 and 2 inches and contains between 2 and 6 apertures, wherein each aperture runs entirely through the ball resulting in two openings on the surface of the ball; each aperture intersects every other aperture and each aperture has a diameter of between about 1/16 and 3/4 inches. More preferably, each aperture has a diameter of between about 1/4 and 1/2 inches. Even more preferably, the ball contains 3 apertures, each having a diameter of about 3/8 inches. Most preferably, the ball is made of a material selected from Aluminum 1100, Aluminum 2011, Aluminum 2017, Aluminum 2024, Aluminum 6061, Aluminum 7074. Aluminum 7075, or Aluminum Bronze.

Figure 2:
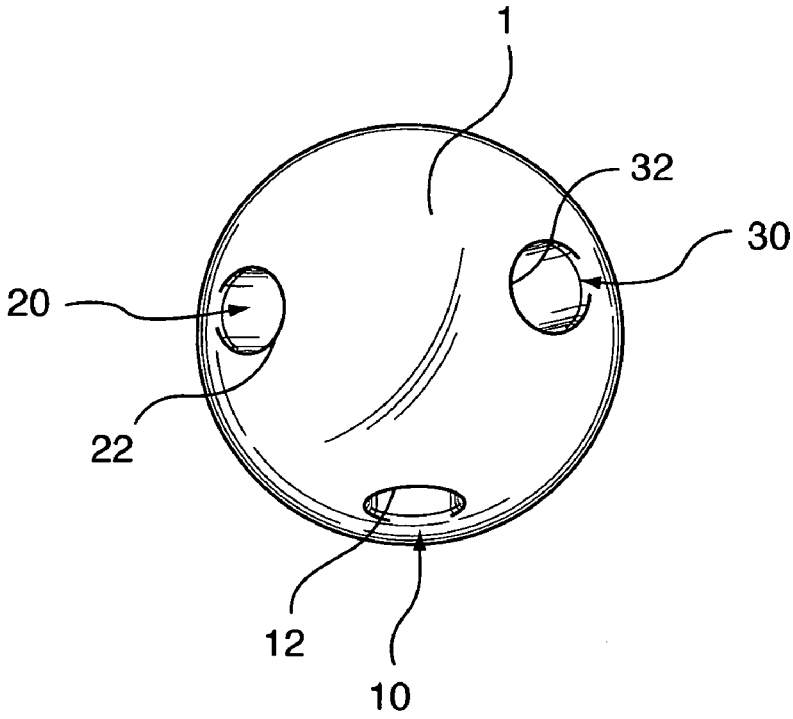
FIG. 2 depicts a bottom rear view perspective of a preferred massage ball of this invention.
Figure 3:
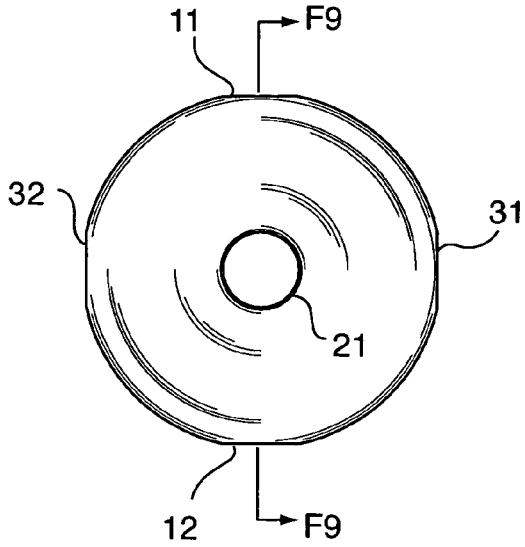
FIG. 3 depicts a front view of a preferred massage ball of this invention.
Figure 4:
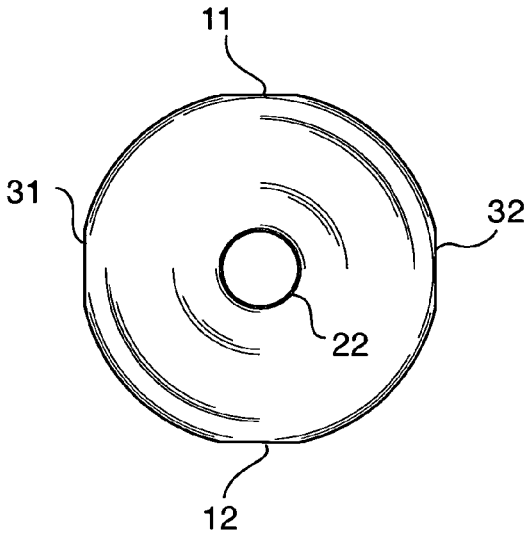
FIG. 4 depicts a rear view of a preferred massage ball of this invention.
Figure 5:
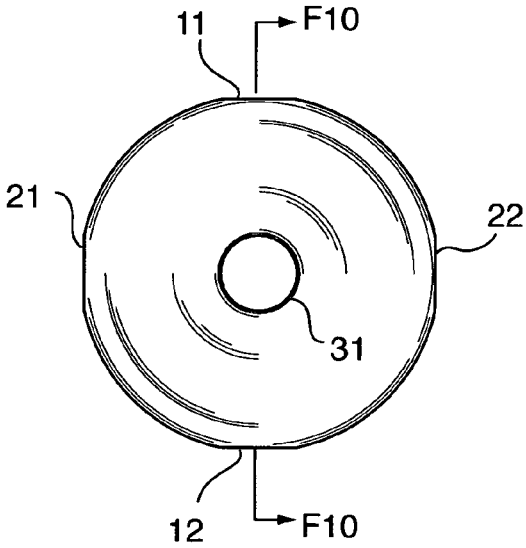
FIG. 5 depicts a left view of a preferred massage ball of this invention.
Figure 6:
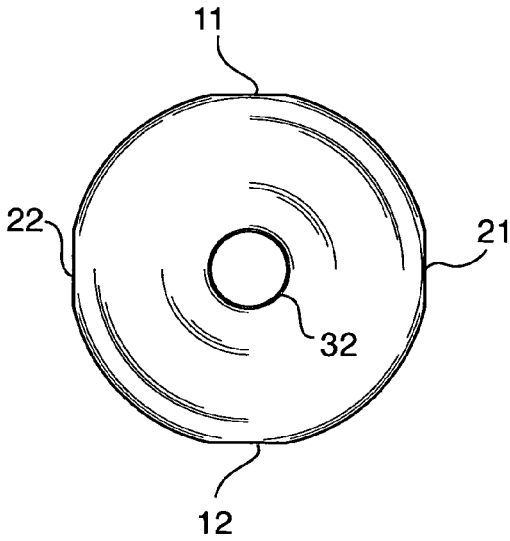
FIG. 6 depicts a right view of a preferred massage ball of this invention.
Figure 7:
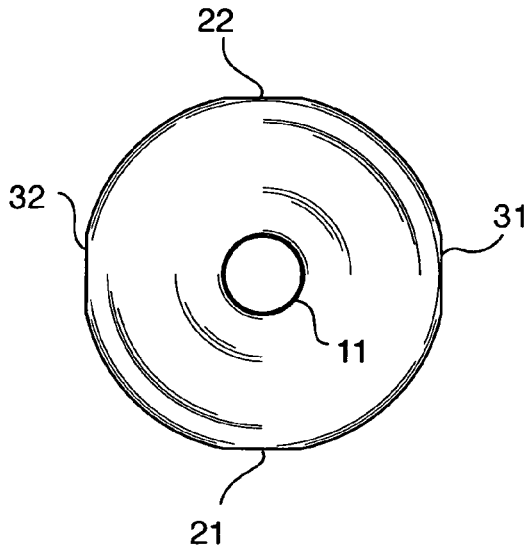
FIG. 7 depicts a top view of a preferred massage ball of this invention.
Figure 8:
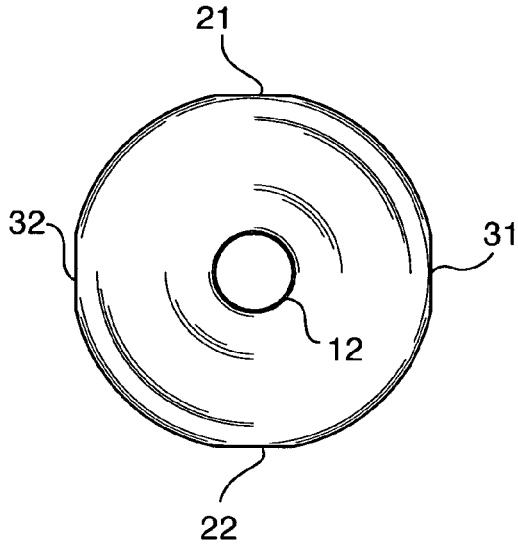
FIG. 8 depicts a bottom view of a preferred massage ball of this invention.
Figure 9:
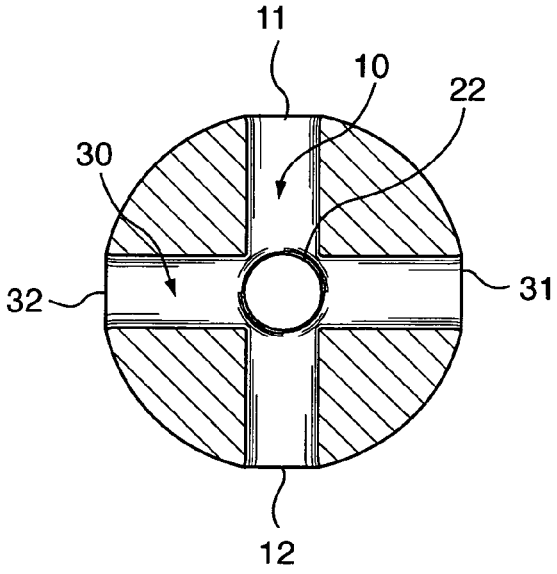
FIG. 9 depicts a front cross-section through the plane indicated in FIG. 3 as F9 of a preferred massage ball of this invention.
Figure 10:
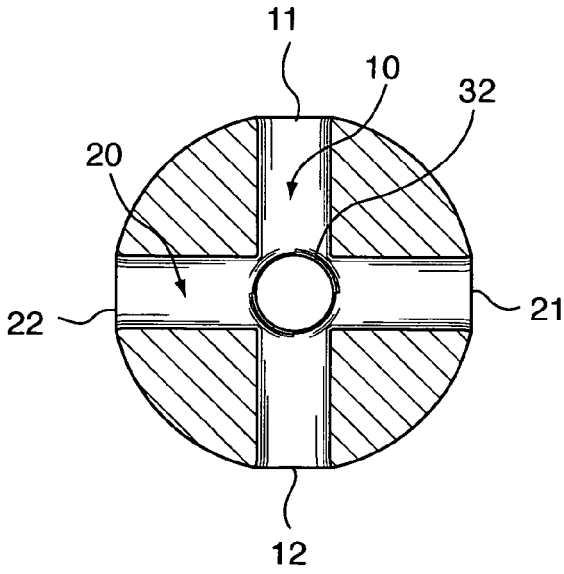
FIG. 10 depicts a left side cross-section through the plane indicated in FIG. 5 as F10 of a preferred massage ball of this invention.

FIG. 1 through 10 depict various views of a preferred embodiment in which a massage ball of this invention has three apertures, each running through the diameter of the ball and each created perpendicular to one another on a different axis (X-, Y- and Z-axes). Referring now to the Figures, a first aperture, represented by arrow 10 is created along the Y-axis resulting in openings 11 and 12 at opposite ends of the ball 1 on that Y-axis. A second aperture represented by arrow 20 is created along the X-axis resulting in openings 21 and 22 at opposite ends of the ball on that X-axis. A third aperture represented by arrow 30 is created along the Z-axis resulting in openings 31 and 32 at opposite ends of the ball on that Z-axis. The three apertures intersect in the middle of the ball. In this preferred embodiment, the diameter of each of the apertures is 3/8 inch.

The advantage of having apertures that run entirely through the ball is that when such balls are heated or cooled by submersion in or placing under running water, the water will not remain in the ball. This provides an advantage in convenience as water remaining in an aperture that does not go entirely through the ball is less easily removed prior to use, but is likely to escape the ball during the massage process. This can cause wetting of the surface against which the user is rolling the ball, resulting in unnecessary clean-up or, in the case of hard surfaces, increased tendency for the ball to slip out from under the user's foot.

Moreover, the presence of apertures running through the entire ball and intersecting with one another allows the ball to be heated or cooled more efficiently when held under running water of an appropriate temperature. This is because the force of the water flowing through the ball in all of the apertures heats or cools the ball from the inside as well as the outside. Heated of cooled water is flowing both around the ball, as well as through it. Balls containing apertures running entirely through also maintain their heat or coolness longer. As the foot rolls over the ball during the massage it blocks some of the openings which, in turn, prevents heat or coolness from escaping from inside of the ball, thus maintaining the temperature for a longer period of time.

Massage balls of this invention containing apertures are preferably polished so as to soften the edges of the resulting openings on the surface of the ball. Unpolished aperture-containing massage balls, while within the scope of the present invention, may prove irritating to the underside of the foot during massage due the rough edges that define the openings on the surface of the ball.

The resulting openings on the surface of the aperture-containing balls of this invention also impart additional and preferable properties to the ball. These include, but are not limited to, better dissipation of therapeutic heat or cold from the ball to the underside of the foot during use; additional massage characteristics to the muscles of the underside of the foot during use; reduced tendency to slip out from under the foot during the massage, particularly if the user is wearing socks, stocking or some other foot covering; and less tendency of the ball to roll off of a surface when not in use if one of the openings of the ball is in contact with a flat surface during storage or other non-use.

The ball may be made up of any material of combination of materials that possess the size and weight characteristics set forth above, as well as the ability to be both heated and cooled to the indicated temperatures without a loss of integrity. The ball must also be sufficiently rigid so as to not deform under the effective pressure range. The term "deform," as used herein, means a temporary loss of the ball's spherical shape. Balls made of soft materials, such as foam rubber, soft rubbers, thin plastic and other soft resins are examples of deformable balls. Applicant has determined that lack of deformity in the ball is critical in providing sufficient resistance against the underside of the foot to administer an effective massage. The ball must also be resistant to shattering, cracking, breaking or otherwise losing its integrity under the effective pressure range of the foot.

Materials which can be used to make the ball include, but are not limited to, Aluminum 1100, Aluminum 2011, Aluminum 2017, Aluminum 2024, Aluminum 6061, Aluminum 7074. Aluminum 7075, Aluminum Bronze, Brass, Bronze, Low Carbon Steel, High Carbon Steel, Chrome Steel, Chrome Steel 52100, Alumina Oxide, Ruby Sapphire, Slicon Nitride, Zirconia, Cobalt, Copper, Borosilicate, Soda-Lime, Hastoloy, KeMonel, M-50, Monel, Nylon, Polyoxymethane, Polypropylene, Polyurethane, Polytetrafluorethylene, Rubber, 302 Stainless Steel, 304 Stainless Steel, 316 Stainless Steel, 316L Stainless Steel, 440 Stainless Steel, 420 Stainless Steel, Tungsten Carbide, Acrylic, Black Phenolic, Boron Carbide, Chrome Carbide, Cobalt Nickel Tungsten, Diamond, Filled Resin, Gold, Haynes LT-1B, Iridium, Inconel, Molybdenum, Niobium, Optical Quality Glass, Piezoelectric Quartz, Platinum, Rockbit, Silver, Sintered Ferrite, Tantalum, Thermoelasomers, Tin, Titanium, Titanium Carbide, Titanium Dibori, Vanadium, Viton®, Wrought Chrome, Ytrium, Zinc Oxide and combinations thereof.

The massage ball utilized in this invention may also be coated or painted with various coatings known in the art. Such coatings are useful to improve aesthetics (e.g, coating which provide higher reflectivity and refractivity of light), and for reducing maintenance (e.g., coatings which impart anti-rusting or anti-scratching properties). Most preferably, the massage ball is anodized which can impart color onto the ball for aesthetic purposes, as well as preventing rust formation. Anodized massage balls of this invention may be further treated to add on a protective coating, such as a clear coat or a color coating.

The method of this invention requires that the temperature of the surface of said ball at initiation of said massage be sufficiently cold or warm to provide therapeutic cold or warmth during the course of an effective massage. The choice of using a cold or a hot ball will be based upon the user's preference and the intended purpose of the massage. For example, inflammation is best reduced through the use of a cooled ball. Muscle tension is best reduced through the use of a warmed ball. Reduction of muscle strain may be achieved with a cooled ball within a few hours of the strain and with a warmed ball thereafter. The user may also use a cooled ball and a warmed ball consecutively, or vice versa. This may easily be achieved by first cooling the ball and using it for an effective massage and then immediately warming the ball and using it for an effective massage. Alternatively one could use separate warmed and cooled balls.

The heating of the balls used in this invention may be achieved by any method known in the art including, but not limited to, immersing in hot water, holding the ball under running hot water, wrapping in a heated towel, wrapping in a heating pad or an electric blanket, placing under one's armpit, wrapping in a microwaveable heat pack, directly heating in a microwave (if ball material is microwaveable), placing in or on top of a flame (if ball material is not flammable), placing in direct sunlight in appropriately warm air temperature, heating with an electric hair dryer or blower, or placing in an electronically driven device which will hold and heat the ball, such as a heat block or a hot water bath into which the ball will fit.

The cooling of the balls used in this invention may be achieved by any method known in the art including, but not limited to, immersing in cold water, holding under running cold water, placing in the refrigerator or freezer, immersing in or placing on top of ice or snow, exposure to appropriately cold air temperature, placing in front of an air conditioner, wrapping in a cold towel or cold pack or placing in an electronically driven cooling device which will hold and cool the ball.

Massage balls of this invention containing apertures advantageously heat and cool to the desired temperature to provide therapeutic warmth or cold much more rapidly than balls lacking apertures. In particular, the appropriate warming and cooling of aperture-containing massage balls of this invention through the use of hot or cold tap water (either by submersion of the ball or simply holding the ball under the water source) can be achieved in as little as 5 to 10 seconds for a ball as depicted in FIGS. 1 through 10, as opposed to about one minute for massage balls of this invention that lack apertures.

It is preferred that the balls of this invention which contain multiple intersecting apertures that run entirely through the ball be warmed or cooled by holding the ball in the palm of the hand placing under running water of an appropriate temperature. This causes water to flow over the ball and to splash through the ball. If one holds the ball under the water while blocking one of the openings, the water tends to be forced out the rest of the openings and over the surface of the entire ball. Either method is suitable for the rapid heating or cooling of the ball.

For warming the preferred ball described immediately above, an appropriate temperature of the running water is between about 100 to 115° F. Some users may not tolerate water temperatures at the upper end of this range while holding the ball under water. Thus, they may use some non-conductive protective device on the hand holding the ball or between the hand and the ball, such as a Playtex® glove or the like. It will be readily apparent that the higher the temperature of water in this range, the faster the ball will heat up and the longer it will retain therapeutic heat during a massage. At the lower end of the temperature range, the preferred ball warms up in about 30 seconds and retains therapeutic warmth for 3 to 5 minutes of massage use. At the higher end of the range, the ball heats up in 5-10 seconds and retains therapeutic warmth for at least 10 minutes of massage use.

For cooling the preferred ball described immediately above, an appropriate temperature of the running water is between about 50 to 55° F. Such temperatures should be tolerable to the hand holding the water, but if not a non-conductive protective device may similarly be employed. It will be readily apparent that the lower the temperature of water in this range, the faster the ball will cool down and the longer it will retain therapeutic cool during a massage. This temperature range typically cools the preferred ball in about 10-15 seconds and the ball retains therapeutic cool for at least 15 minutes of use.

The massage ball may have a smooth or a rough surface. The term "rough surface" includes any surface not smooth to the touch, such as ridged, dimpled, scuffed or brushed (as in brushed metal) surfaces, as well as any surface containing protrusions. In a preferred embodiment, the surface of the massage ball is smooth.

In another preferred embodiment the ball is made of a material which:

a) when submerged in hot water having a temperature of about 115° F. for one minute immediately prior to initiation of said massage will provide therapeutic warmth for at least three minutes during said massage at an air temperature of between 65° F. and 75° F.;

b) when submerged in cold water having a temperature of about 55° F. for one minute immediately prior to initiation of said massage will provide therapeutic cold for at least three minutes during said massage at an air temperature of between 65° F. and 75° F.; and c) is non-deformable under the effective pressure range.

Applicant has determined that therapeutic warmth is provided for the average user when the ball maintains a surface temperature of at least 95° F. Therapeutic cold is provided for the average user when the ball maintains a surface temperature of no greater than 70° F.

The water temperatures indicated above are temperatures that are typically achieved with hot and cold tap water, respectively. Thus, they may advantageously be achieved in any location that has plumbing with hot and cold running water. Moreover, applicant has found that submerging the ball utilized in this invention in water having the indicated temperature for one minute immediately prior to the massage sufficiently heats or cools the ball so as to deliver to the user a therapeutic hot or cold sensation throughout the extent of an effective massage.

In another preferred embodiment the ball described above is made of a material that comprises at least one aperture. More preferably the ball contains between 1 and 50 apertures, wherein each aperture independently has a diameter of between 1/16 and 3/4 inches. Even more preferably, the ball comprises one aperture that runs through the ball thus resulting in two opening on the surface of the ball. In an even more preferred embodiment, the ball comprises one aperture that runs through a diameter of the ball. In one of the most preferred embodiment, the ball contains between 2 and 6 apertures, wherein each aperture runs entirely through the ball; and each aperture intersects every other aperture. Even more preferred is that each aperture has a diameter of between about 1/4 and 1/2 inches. Balls containing three apertures, wherein an aperture runs through a diameter of the ball on each of the X-, Y- and Z-axes of the ball are most preferred. In the most preferred embodiment, the diameter of each aperture is about 3/8 inches.

Thus according to a preferred embodiment, the ball contains between 2 and 6 apertures, wherein each aperture runs entirely through the ball; each aperture intersects every other aperture and each aperture has a diameter of between 1/16 and 3/4 inches and is made of a material which a) when submerged in or held under running hot water having a temperature of about 115° F. for ten seconds immediately prior to initiation of said massage will provide therapeutic warmth for at least three minutes during said massage at an air temperature of between 65° F. and 75° F.;

b) when submerged in or held under running cold water having a temperature of about 55° F. for ten seconds immediately prior to initiation of said massage will provide therapeutic cold for at least three minutes during said massage at an air temperature of between 65° F. and 75° F.; and c) is non-deformable under the effective pressure range.

More preferably, each aperture has a diameter of between 1/4 and 1/2 inch. Most preferably, the ball contains three apertures, wherein an aperture runs through a diameter of the ball on each of the X-, Y- and Z-axes and wherein the diameter of each aperture is about 3/8 inches Balls made out of any material or combination of material may be utilized in this invention. Preferred materials for balls lacking apertures and in the 6 to 24 ounce weight range, preferably the 12 to 14 ounce range are selected from Chrome Steel, Chrome Steel 52100, 302 Stainless Steel, 304 Stainless Steel, 316 Stainless Steel, 316L Stainless Steel, 440 Stainless Steel or 420 Stainless Steel. Most preferred is 420 Stainless Steel or Chrome Steel 52100.

Preferred materials for balls in the 3 to 10 ounce range are 1100 Aluminum, 2017 Aluminum, 2011 Aluminum, 6061 Aluminum, 7074 Aluminum 7075 Aluminum and Aluminum Bronze. Most preferred is Aluminum 2011 due to its cost and standard availability. These aluminum materials are also preferred for balls comprising at least one aperture; preferably at least one aperture running through the diameter of the ball; more preferably between 2 and 6 apertures, wherein each aperture runs entirely through the ball, each aperture intersects every other aperture and each aperture has a diameter of between 1/16 and 3/4 inches; more preferably wherein each aperture has a diameter of between 1/4 and 1/2 inch; and most preferably wherein the ball has three apertures, wherein an aperture runs through a diameter of the ball on each of the X-, Y- and Z-axes and wherein the diameter of each aperture is about 3/8 inches.

According to an alternate embodiment, the ball is optionally magnetized. It will be apparent that only certain materials are capable of being magnetized and thus this particular embodiment excludes balls made of materials that cannot be magnetized. Magnetization of the appropriate materials may be achieved by any method known in that art. The magnetized ball is preferably used in conjunction with a magnetic mat.

According to yet another embodiment, the invention provides a massage ball kit comprising a single, individually packaged ball having a diameter of between 1.5 and 2 inches, a weight of between 6 and 16 ounces, and being made of a material which:

a) when submerged in hot water having a temperature of about 115° F. for one minute immediately prior to initiation of a massage will provide therapeutic warmth for at least three minutes during said massage at an air temperature of between 65° F. and 75° F.;

b) when submerged in cold water having a temperature of about 55° F. for one minute immediately prior to initiation of said massage will provide therapeutic cold for at least three minutes during said massage at an air temperature of between 65° F. and 75° F.; and c) does not deform during said massage, wherein said massage comprises simultaneously contacting said ball with both the underside surface of a foot and a rigid surface; and moving said foot while maintaining sufficient pressure between said ball and said underside of the foot so as to roll said ball against both said rigid surface and said underside of the foot for a time sufficient to administer said massage; and instructions for using said ball to massage an underside of a human foot.

In this embodiment, the ball is as described above. Preferred embodiment of the ball in the kit of this invention are also as described above. The instructions in the kit may be printed directly on the packaging of the ball and/or as a printed insert packaged together with the ball. The instructions will include directions for using the ball for administering an effective massage to the underside of the foot, as well as directions for heating and cooling the ball to the appropriate temperature for providing therapeutic heat or cold during an effective massage. The instructions for using the ball for a massage may comprise diagrams, as well as printed instructions.

In another preferred embodiment the ball in the kit described above is made of a material that comprises at least one aperture. Preferential numbers, diameters and lengths of the apertures are identical to those described above.

Thus, according to a highly preferred embodiment, the invention provides a massage ball kit comprising a single, individually packaged ball having a diameter of between 1.5 and 2 inches, a weight of between 3 and 10 ounces, and being made of a material which:

a) contains between 2 and 6 apertures, wherein each aperture runs entirely through the ball; each aperture intersects every other aperture and each aperture has a diameter of between 1/16 and 3/4 inches;

b) when submerged in or held under running hot water having a temperature of about 115° F. for ten seconds immediately prior to initiation of said massage will provide therapeutic warmth for at least three minutes during said massage at an air temperature of between 65° F. and 75° F.;

c) when submerged in or held under running cold water having a temperature of about 55° F. for ten seconds immediately prior to initiation of said massage will provide therapeutic cold for at least three minutes during said massage at an air temperature of between 65° F. and 75° F.; and a) is non-deformable under the effective pressure range.

wherein said massage comprises simultaneously contacting said ball with both the underside surface of a foot and a rigid surface; and moving said foot while maintaining sufficient pressure between said ball and said underside of the foot so as to roll said ball against both said rigid surface and said underside of the foot for a time sufficient to administer said massage; and instructions for using said ball to massage an underside of a human foot.

More preferably, the apertures have a diameter of between 1/4 and 1/2 inch. Most preferably, the ball contains three apertures, wherein an aperture runs through a diameter of the ball on each of the X-, Y- and Z-axes and wherein the diameter of each aperture is about 3/8 inches.

In one preferred embodiment, the massage ball kit additionally includes a device for heating and/or cooling the ball. Such a device may be an electric or manual device into which the ball is placed or contacted and that, after a period of time, heats or cools the ball to a temperature either pre-set within the device or variably set by the user. The device will typically comprise a means for heating or cooling and insulation material for maintaining the desired temperature of the ball.

Means for electrically heating the ball typically comprise an electrically controlled heating element and a heat conducting material. The heat conducting material typically forms the walls of a chamber into which the ball is placed. The heating element either heats the heat conducting material directly or indirectly, for example by heating water or other heat retaining liquid which is in contact with the heat conducting material. Alternatively, heating means may be a chamber made of heat conducting material which is contacted with hot water that is heated outside the device and then introduced into the device. In embodiments where the heat conducting material is in contact with heated water or other liquid, the heated water or liquid may either be within the chamber into which the ball is placed (and thus the ball placed or submerged in that liquid) or may be in a separate chamber which surrounds and is in direct contact with the chamber into which the ball is placed.

Means for electrically cooling the ball typically comprise an electrically controlled refrigerant or cooling element and a cold conducting material. The cold conducting material typically forms the walls of a chamber into which the ball is placed. The refrigerant or cooling element either cools the cold conducting material directly or indirectly, for example by cooling water or other liquid which is in contact with the cold conducting material. Alternatively, cooling means may be a chamber made of cold conducting material which is contacted with cold water that is cooled outside the device and then introduced into the device. In embodiments where the cold conducting material is in contact with cooled water, the cooled water may either be within the chamber into which the ball is placed or may be in a separate chamber which surrounds and is in direct contact with the chamber into which the ball is placed.

Heat- and cold-conducting materials are well known in the art and are typically metals or metal alloys, such as stainless steel.

According to yet another preferred embodiment, the massage ball kit further comprises a mat having at least one non-skid surface and preferably two non-skid surfaces. The non-skid surfaces may be made of any materials known in the art to have non-skid properties. This includes, but is not limited to, natural and synthetic rubber and other synthetic materials that are well-known in the art and widely available. The mat is particularly useful when the massage is to be performed on a hard floor. The mat prevents the ball from losing contact with the underside of the foot due to high pressure that would otherwise cause the ball to skid out from under the foot. The mat can come in any shape or size, but is preferably a square or a circle having an area of between about 0.1 to 2 square feet. More preferably the mat is a circle having a diameter of between 4 and 8 inches or a square having sides of between 4 and 8 inches.

In one alternate embodiment, the mat is a magnet, such as a sheet magnet which, when used in conjunction with a massage ball of this invention that is magnetized, will aid in preventing slippage of the ball under the foot. This will allow the user to place higher pressure on the ball during the massage (e.g., the upper end of the effective pressure range is increased), thus allowing for a deeper massage.

According to an alternative embodiment, the massage ball of this invention may have a flattened end. The face of the flattened end is preferably round with a diameter of between 5/16 to 1/2 inches. Preferably the flattened end is about 3/8 inches in diameter.

The flattened end on a massage ball of this invention provides stability when the ball is placed on a surface when not in use. The flattened end can easily be achieved by slicing a small piece off of the end of the ball during the manufacturing process. While the resulting product is not technically a sphere or a ball, the term "massage ball", as used herein is intended to include products described herein that comprise a flattened end, as well as kits containing such products and methods of using such products.

Massage balls of this invention comprising a flattened end may also comprise an aperture as described above. Because of manufacturing issues, massage balls comprising a flattened end preferably comprise an aperture through the flat face. Such an aperture is preferably between about 1/16 to 3/8 inches in diameter, more preferably between about 1/8 and 3/16 inches in diameter. The length of the aperture through the flat face is at least 1/4 inches and may extend entirely through to the other side of the ball. More preferably, the aperture through the flat face is between 1/4 inches and a length that does not extend through to the other side of the ball (i.e., result in only one opening on the surface of the ball.

According to another embodiment, the massage ball kit of this invention additionally comprises a storage device for said ball. Storage devices useful in the kits of this invention include decorative bags (e.g., a velvet bag with a drawstring for closure), boxes (e.g., a wooden box with a receptacle for the ball inside the box) or other closable containers, as well as open holders, such as decorative platforms upon which the ball sits is otherwise contained while remaining visible.

In a preferred embodiment, the ball is either made of a material having an aesthetically pleasing appearance or is coated with a material having an aesthetically pleasing appearance. This includes, but is not limited to highly reflective finishes and matte finishes. Such a preferred ball is designed to be viewed when not in use and is typically stored on a desk or a shelf where it is visible. Accordingly, the storage device for this preferred ball is preferably a platform or stand upon which the ball sits. The preferred platform or stand should also be made out of materials that are aesthetically pleasing when the ball is placed on it. The preferred platform or stand may also comprise a concave depression, opening, prongs or other means for holding the ball sits so it does not roll off. When the platform or stand is used in conjunction with a magnetized massage ball of this invention, a magnet within the storage device may be used to keep the ball in place when not in use. In one embodiment, the magnetic mat may also be used as a storage device.

In order that the invention described herein may be more fully understood, the following examples are set forth. It should be understood that these examples are for illustrative purposes only and are not to be construed as limiting this invention in any manner.

EXAMPLE 1

A 1.75 inch diameter ball weighing 12.7 ounces and made of 52100 chrome alloy steel was used for determining temperature retention characteristics. The ball was placed in cold water baths of varying temperatures for one minute, quickly dried with a towel and then immediately used to massage the underside of the foot as described above. Immersion in a 40° F. water bath for one minute caused the ball to become too cold to place the foot upon. A one minute incubation in a 49° F. water bath produced a ball that felt very cold on the underside of the foot, but was tolerable enough to perform an effective massage. A 55° F. water bath incubation produced the optimum feeling of coolness, while being comfortable enough to perform an effective massage. It was determined that a one minute 55° F. water bath incubation, produced a therapeutic cool feeling to the user for an effective massage lasting 3 to 6 minutes, depending upon the sensitivity of the user. A 68° F. water bath produced a ball that felt cool to the foot, but the cool sensation did not last long enough for an effective massage.

A similar set of experiments was performed with a one minute submersion in higher temperature water. It was determined that a one minute temperature incubation in any water temperature over 120° F. heated the ball to a temperature that could be tolerated by the user. An incubation in water of 110° F. for one minute optimally warmed the ball for use in an effective massage. This procedure produced a ball which retained a therapeutically warm feel to the user during an effective massage lasting for between 4 and 8 minutes, depending upon the sensitivity of the user.

EXAMPLE 2

Twelve individuals were each provided with a 1.75 inch diameter ball weighing 12.7 ounces and made of 52100 chrome alloy steel that had been heated by submersion in water having a temperature of 115° F. for 30-60 seconds. None of the users were suffering from foot pain. Some of the users wore socks during the test, while other had bare feet. The users were told to roll the ball under their feet on a carpeted surface for 3 to 5 minutes and then asked to comment on the experience. All users had positive feedback on the ball. The users generally commented that the ball felt good and was comfortable during the massage. All users felt the heat of the ball during the massage, even those that used the ball wearing socks. None of the users had any negative comments about the ball the temperature of the ball or the massage it provided.

EXAMPLE 3

Three 3/8 inches diameter apertures are drilled entirely through the diameter on each of the X-, Y- and Z-axes of a 1.75 inch diameter ball weighing approximately 4 ounces and made of Aluminum 2011. The apertures intersect each other in the middle of the ball. This produces a ball containing 6 openings on its surface (two each at the ends of each of the X-, Y- and Z-axes (see FIGS. 1 through 10). The ball is then polished so as to remove any irritating edges around the openings and anodized to prevent rusting.

The ball is held in one's hand and placed under running warm water having a temperature of about 110° F. for 5 to 10 seconds. After drying the ball is immediately used to massage the bottom of the foot as described above. Therapeutic warmth is experienced by the user for at least 8 minutes of constant massage. If the ball is dried and not used for massage it will retain therapeutic heat for at least 30 minutes. Therefore the user is not required to use the massage ball immediately after heating.

The same ball is allowed to cool to room temperature. It is then held in one's hand and placed under running cool water having a temperature of about 55° F. for 5 to 10 seconds. After drying the ball is immediately used to massage the bottom of the foot as described above. Therapeutic cool is experienced by the user for at least 8 minutes of constant massage. If the ball is dried and not used for massage it will retain therapeutic cool for at least 30 minutes. Therefore the user is not required to use the massage ball immediately after cooling.

When the user performs the massage using the heated or cooled aperture-containing ball described above while wearing thin socks, the therapeutic heat or cool is observed to last longer than in bare feet. Without being bound by theory, I believe this is due to the fact that the user's body heat has less of an influence on the temperature of the ball. Accordingly, it is therefore apparent that the massage ball of this invention can be used while the user is wearing socks covering the foot being massaged as well as when that foot is bare.

While a number of embodiments of this invention are described herein, it is apparent that my basic examples may be altered to provide other embodiments of this invention. Therefore, it will be appreciated that the scope of this invention is to be defined by the appended claims rather than by the specific embodiments which have been represented by way of example.

I claim:

1. A method of simultaneously providing an effective massage and a therapeutic hot or cold treatment to an underside surface of a human foot comprising the steps of:

a) simultaneously contacting a freestanding ball with both the underside surface of the foot and a rigid surface; and b) moving said foot while maintaining sufficient pressure between said ball and said underside of the foot so as to roll said ball against both said rigid surface and said underside of the foot for a time sufficient to administer said effective massage, wherein said ball is between 1.5 and 2 inches in diameter, said ball weighs between 3 and 24 ounces, said ball does not deform during said massage, and said ball is sufficiently cold or sufficiently warm to provide the user with therapeutic cold or warmth during the course of an effective massage, wherein said ball optionally comprises an aperture and wherein said ball optionally contains a flat face, wherein said ball contains three apertures, wherein each of said apertures runs through a diameter of said ball corresponding to each of the X-, Y- and Z-axes, wherein the diameter of each aperture is about ⅜ inches and wherein said ball is made of a material which a) when submerged in or held under running hot water having a temperature of about 115° F. for ten seconds immediately prior to initiation of said massage will provide therapeutic warmth for at least three minutes during said massage at an air temperature of between 65° F. and 75° F.; and b) when submerged in or held under running cold water having a temperature of about 55° F. for ten seconds immediately prior to initiation of said massage will provide therapeutic cold for at least three minutes during said massage at an air temperature of between 65° F. and 75° F.

2. The method according to claim 1, wherein said therapeutic warmth is provided by a ball maintaining a surface temperature of at least 95° F.; and wherein said therapeutic cold is provided by a ball maintaining a surface temperature of not greater than 70° F.

3. The method according to claim 1, wherein said ball is about 1.75 inches in diameter and weighs between about 12 and about 14 ounces.

4. The method according to claim 3, wherein said ball is composed of a material selected from Chrome Steel, Chrome Steel 52100, 302 Stainless Steel, 304 Stainless Steel, 316 Stainless Steel, 316L Stainless Steel, 440 Stainless Steel or 420 Stainless Steel.

5. The method according to claim 4, wherein said ball is composed of Chrome Steel 52100 or 420 stainless steel.

6. The method according to claim 1, wherein said ball is about 1.75 inches in diameter and weighs between about 3 and about 10 ounces.

7. The method according to claim 6, wherein said material is selected from 1100 Aluminum, 2017 Aluminum, 2011 Aluminum, 6061 Aluminum, 7074 Aluminum 7075 Aluminum and Aluminum Bronze.

8. The method according to claim 7, wherein said material is Aluminum 2011.

9. The method according to claim 1, wherein said ball is ball is anodized and polished.

10. The method according to claim 1, wherein said ball is magnetized.

11. The method according to claim 1, wherein said ball has a flat face.

12. The method according to claim 11, wherein said flat face is circular and has a diameter of between about 1/16 to ⅜ inches.

13. The method according to claim 12, wherein the diameter of said flat face is about ⅛ inch.

14. The method according to claim 11, wherein said ball has an aperture through said flat face of at least ¼ inches in length.

15. A massage ball kit comprising a single, individually packaged ball having a diameter of between 1.5 and 2 inches, a weight of between 3 and 10 ounces, said ball containing three apertures, wherein each of said apertures runs through a diameter of said ball corresponding to each of the X-, Y- and Z-axes, respectively, of said ball; wherein the diameter of each aperture is about ⅜ inches and wherein said ball is made of a material which:

a) when submerged in or held under running hot water having a temperature of about 115° F. for ten seconds immediately prior to initiation of said massage will provide therapeutic warmth for at least three minutes during said massage at an air temperature of between 65° F. and 75° F.;

b) when submerged in or held under running cold water having a temperature of about 55° F. for ten seconds immediately prior to initiation of said massage will provide therapeutic cold for at least three minutes during said massage at an air temperature of between 65° F. and 75° F.; and c) does not deform during said massage;

wherein said massage comprises simultaneously contacting said ball with both the underside surface of a foot and a rigid surface; and moving said foot while maintaining sufficient pressure between said ball and said underside of the foot so as to roll said ball against both said rigid surface and said underside of the foot for a time sufficient to administer said massage, wherein said ball optionally contains a flat face; and instructions for using said ball to massage an underside of a human foot.

16. The massage ball kit according to claim 15, wherein said therapeutic warmth is provided by a ball maintaining a surface temperature of at least 95° F.; and wherein said therapeutic cold is provided by a ball maintaining a surface temperature of not greater than 70° F.

17. The massage ball kit according to claim 15, wherein said ball is about 1.75 inches in diameter.

18. The massage ball kit according to claim 17, wherein said ball is composed of a material selected from Chrome Steel, Chrome Steel 52100, 302 Stainless Steel, 304 Stainless Steel, 316 Stainless Steel, 316L Stainless Steel, 440 Stainless Steel or 420 Stainless Steel.

19. The massage ball kit according to claim 18, wherein said ball is composed of Chrome Steel 52100 or 420 Stainless Steel.

20. The massage ball kit according to claim 15, wherein said ball is about 1.75 inches in diameter and weighs between about 3 and about 10 ounces.

21. The massage ball kit according to claim 20, wherein said material is selected from 1100 Aluminum, 2017 Aluminum, 2011 Aluminum, 6061 Aluminum, 7074 Aluminum 7075 Aluminum or Aluminum Bronze.

22. The massage ball kit according to claim 21, wherein said material is Aluminum 2011.

23. The massage ball kit according to claim 15, wherein said ball is anodized.

24. The massage ball kit according to claim 15, wherein said ball is magnetized.

25. The massage ball kit according to claim 15, additionally comprising a device for heating and/or cooling said ball.

26. The massage ball kit according to claim 15, additionally comprising a mat having at least one non-skid surface.

27. The massage ball kit according to claim 15, additionally comprising a mat having magnetic properties.

28. The massage ball kit according to claim 15, additionally comprising a storage device for said ball.

29. The massage ball kit according to claim 15, additionally comprising a storage device having magnetic properties.

30. The massage ball kit according to claim 15, wherein said ball has a flat face.

31. The massage ball kit according to claim 30, wherein said flat face is circular and has a diameter of between about 1/16 to 3/8 inches.

32. The massage ball kit according to claim 31, wherein the diameter of said flat face is about 1/8 inch.

33. The massage ball kit according to claim 30, wherein said ball has an aperture through said flat face of at least 1/4 inches in length.

34. A massage ball having:

a) a weight of between 3 and 24 ounces;

b) a diameter of between 1 1/2 and 2 inches;

c) between 2 and 6 apertures, wherein each aperture runs entirely through the ball; each aperture intersects every other aperture and each aperture has a diameter of between 1/16 and 3/4 inches, wherein said ball is made of a material which:

d) when submerged in or held under running hot water having a temperature of about 115° F. for ten seconds immediately prior to initiation of an effective foot massage will provide therapeutic warmth for at least three minutes during said massage at an air temperature of between 65° F. and 75° F.;

e) when submerged in or held under running cold water having a temperature of about 55° F. for ten seconds immediately prior to initiation of said effective foot massage will provide therapeutic cold for at least three minutes during said massage at an air temperature of between 65° F. and 75° F. and d) does not deform during said massage.

35. The massage ball according to claim 34, wherein said ball has a weight of between 3 and 10 ounces.

36. The massage ball according to claim 34, wherein said ball has a diameter of about 1 3/4 inches.

37. The massage ball according to claim 34, wherein each of said apertures has a diameter of between 1/4 and 1/2 inches.

38. The massage ball according to claim 34, wherein said ball contains three apertures, wherein each of said apertures runs through a diameter of said ball corresponding to each of the X-, Y- and Z-axes, respectively, of said ball; and wherein the diameter of each aperture is about 3/8 inches.

39. The massage ball according to claim 34, wherein said ball is made of a material selected from 1100 Aluminum, 2017 Aluminum, 2011 Aluminum, 6061 Aluminum, 7074 Aluminum 7075 Aluminum or Aluminum Bronze.

* * * * *